United States Patent [19]

Vanecek et al.

[11] 4,218,048

[45] Aug. 19, 1980

[54] SUSPENDED GAS SHROUD APPARATUS

[75] Inventors: Michael J. Vanecek; John H. K. Piepenhagen; Michael J. Neale; Steven M. Lasiter, all of Beaumont; Raymond A. Bailey, Port Neches, all of Tex.

[73] Assignee: Georgetown Texas Steel Corp., Beaumont, Tex.

[21] Appl. No.: 961,597

[22] Filed: Nov. 17, 1978

[51] Int. Cl.[3] ..... C21C 5/42

[52] U.S. Cl. ..... 266/236; 164/259; 164/415; 266/287

[58] Field of Search ..... 266/236, 242, 287, 903; 164/259, 415, 437

[56] References Cited

U.S. PATENT DOCUMENTS

| | | | |
|---|---|---|---|
| 3,439,735 | 4/1969 | Holmes | 164/437 |
| 3,554,520 | 1/1971 | Grosko | 266/287 |
| 3,572,422 | 3/1971 | Lyman | 164/437 |
| 3,616,843 | 11/1971 | Newhall et al. | 164/437 |
| 3,841,385 | 10/1974 | Burk | 164/259 |
| 3,908,734 | 9/1975 | Pollard | 164/415 |
| 4,084,799 | 4/1978 | Coward et al. | 164/415 |
| 4,091,861 | 5/1978 | Thalmann et al. | 164/437 |
| 4,102,386 | 7/1978 | Hildenbrandt et al. | 164/437 |

*Primary Examiner*—L. Dewayne Rutledge
*Assistant Examiner*—Michael L. Lewis
*Attorney, Agent, or Firm*—Ralph H. Dougherty

[57] ABSTRACT

A shrouding apparatus, suspended from a bottom pour vessel carries a vertical shroud tube at one end for surrounding a molten metal pouring stream and a counterweight at its other end to force the shroud tube against the bottom of the pouring vessel. The apparatus includes means for introducing a protective atmosphere to the interior of the shroud.

2 Claims, 6 Drawing Figures

SUSPENDED GAS SHROUD APPARATUS

BACKGROUND OF THE INVENTION

This invention relates to an improved gas shroud apparatus for protecting a molten pouring stream issuing from a bottom pour vessel from atmospheric reoxidation. The invention is particularly well suited to the casting of steel from a tundish.

In the continuous casting of molten metals such as steel the molten metal is teemed from a ladle into an intermediate pouring vessel known as a tundish. Each tundish has at least one and normally a multiplicity of pouring nozzles in its bottom wall to feed a like number of continuous casting molds. The molten metal pouring stream is subject to atmospheric reoxidation which will result in the formation of oxide inclusions in the continuous cast product. Additional production cost is required to remove such inclusions prior to fabricating the cast product into a finished product. In addition, trapped inclusions result in unacceptable product cleanliness.

Shrouding of molten metal pouring streams in the continuous casting of steel is well known in the art as exemplified by Lyman U.S. Pat. No. 3,572,422, Pollard U.S. Pat. No. 3,908,734, Holmes U.S. Pat. No. 3,439,735, Newhall et al U.S. Pat. No. 3,616,843 and Coward et al U.S. Pat. No. 4,084,799.

In order that stream characteristics and the metal in the continuous casting mold can be observed, there must be a gap between the bottom of the shroud and the metal meniscus in the mold. In addition, it is desirable to have a readily removable shroud to accommodate other apparatus beneath the pouring stream such as a launder to divert the pouring stream from the mold when there is a breakout or other problem. In addition, the shroud must be removable to allow access to the pouring nozzle by an oxygen lance or chill plug.

As has been seen in Coward et al U.S. Pat. No. 4,084,799, stream cleanliness is highest when the shroud is tightly sealed against the tundish to prevent entrance of atmospheric oxygen to the top of the shroud and entrainment of oxygen in the pouring stream. Previous shrouds which were tightly positioned against the bottom of the tundish have been supported by a mechanism either on the pouring floor as taught by Coward et al, or on the mold itself as in the bellows-type shroud of Newhall et al. We have invented a shroud apparatus which is pivotally suspended from a bottom pour tundish or other bottom pour vessel and is held sufficiently tight against the bottom of the tundish to provide a substantially gas tight seal by the expedient of providing a counterweight at the outer extremity of the shroud support arm. The counterweight may be adjustably positionable on the support arm if desired. The shroud may readily be moved into and out of the operative position as required with a minimum of effort. The shroud of the present application is particularly well suited to installations where a launder is employed as well as to installations not employing a launder. The shroud may be completely removed by lifting it from its suspension means, or it may be pivoted out of the way by striking it with a launder, or it may simply be rotated out of the operative position manually.

Shrouding with liquid nitrogen is currently practiced at some continuous steel casting installations. The liquid nitrogen is sprayed onto the tundish pouring stream from an annular spray ring which encircles the pouring stream. This is an efficient but extremely costly means of shrouding which uses copious quantities of nitrogen. The present invention is extremely inexpensive and uses nitrogen sparsely. In fact, normal nitrogen usage when casting $5\frac{1}{8}'' \times 5\frac{1}{8}''$ billets is less than 85 cu. ft. per ton of product.

OBJECT OF THE INVENTION

It is a principal object of this invention to provide a shrouding apparatus suspendable from a bottom pour vessel which will protect a molten metal pouring stream issuing from such vessel from atmospheric contamination.

It is also an object of this invention to provide a shrouding apparatus which is not in a fixed position and which is readily positionable against a tundish bottom to provide a gas-tight seal, yet quickly removable when necessary.

It is another object of this invention to provide means for mounting shrouding apparatus on a tundish.

DETAILED DESCRIPTION OF THE DRAWINGS

The foregoing and other objects will become more readily apparent by referring to the following detailed specification and the appended drawings in which.

DETAILED DESCRIPTION

Figure 1:
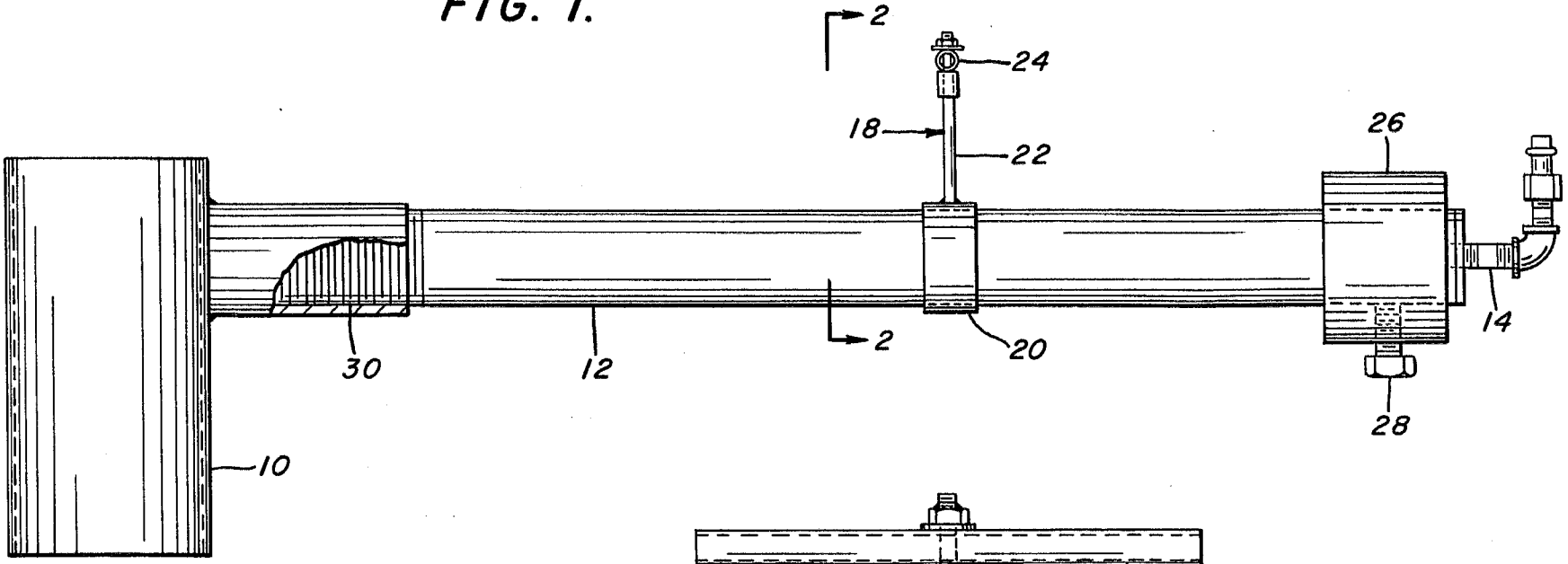
FIG. 1 is a side elevational view of the shroud apparatus of the invention.

Referring now to FIG. 1, shroud tube 10 which is preferably cylindrical, is affixed to one end of a shroud tube support arm 12 which is hollow and has a gas conduit 14 affixed to the end opposite the shroud tube for delivering shrouding gas through the support arm to the interior of the shroud tube. A support arm suspending means 18 engages the support arm 12 as shown. Support arm holder 20 is fastened to a connecting member 22 which is in turn fixed to an axle 24 which is normal to the connecting member 22 forming a tee therewith. A counterweight 26 is positioned on support arm 12 between suspending means 18 and the arm extremity opposite the shroud tube. This counterweight may be adjustably positionable on the support arm and may be held in a desired position by means such as set screw 28.

The shroud tube 10 may be removably connected to the shroud tube support arm by such means as a swaged connection or a threaded connection 30 in order to readily change the shroud tube which is the portion of the apparatus most subject to damage.

Figure 2:
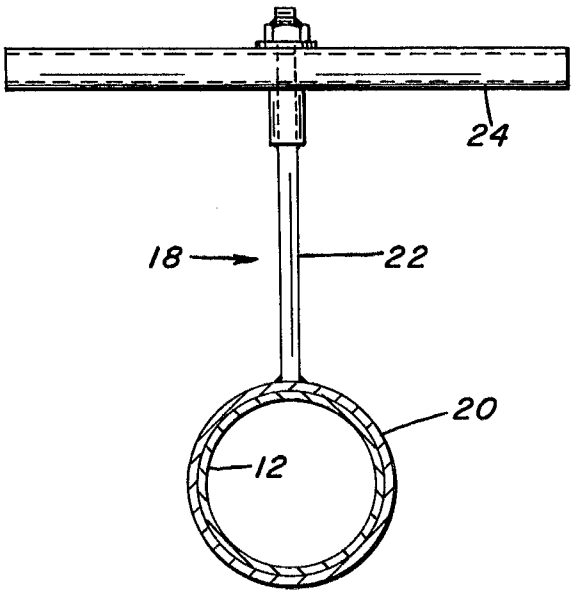
FIG. 2 is a detailed view of the shroud suspension means taken along line 2—2 of FIG. 1.

The suspending apparatus as shown in FIG. 2 preferably allows rotation of axle 24 about connecting member 22. Note that support arm holder 20 has a cross-sectional shape which will engage arm 12. Only an extremely small clearance is provided between these two members, thus the support arm will not be slidable in member 20 during the pouring operation. The support arm 12 and support arm holder 20 are both shown as cylindrical but these may be of any other desired tubular geometric shape. Alternatively the support arm holder may carry any suitable connecting means at its lower end such as a clamp.

Figure 3:
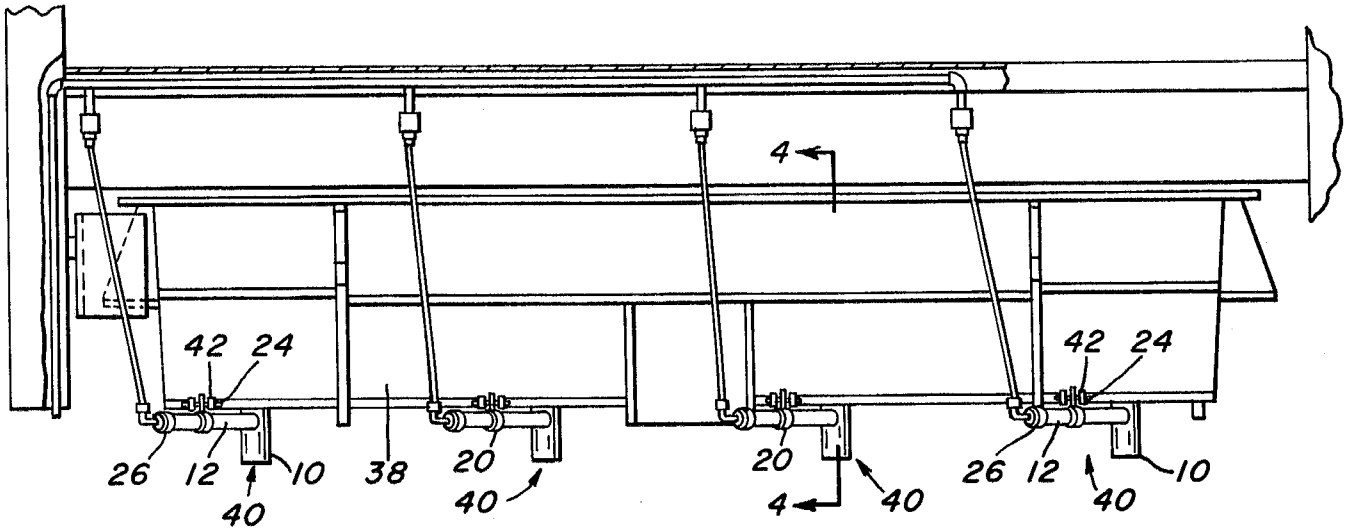
FIG. 3 is a side elevational view of a tundish having four bottom pour nozzles each with the invented shroud in the active position.
Figure 4:
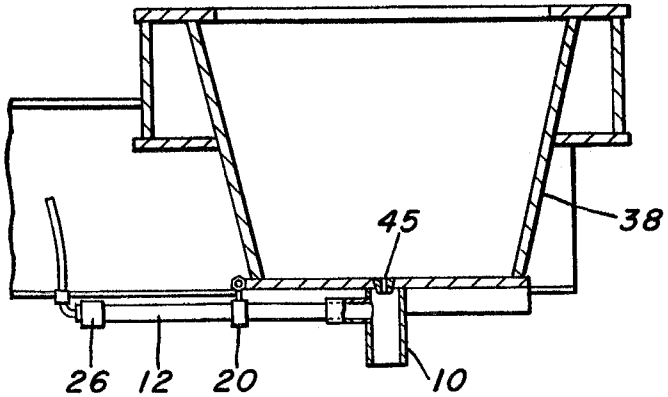
FIG. 4 is a sectional view of the tundish and shroud taken along line 4—4 of FIG. 3.

FIG. 3 shows a tundish 38 with four shroud tube assemblies 40 suspended from the tundish in the operating position. Axle 24 is journaled in receptacle 42 which is fixed to the bottom of the tundish at the desired location. FIG. 4 shows the shroud assembly in the operative position around tundish nozzle 45.

Figure 6:
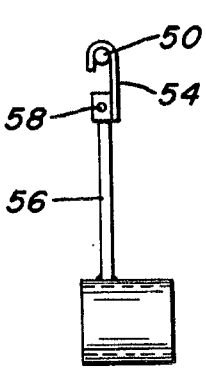
FIG. 6 is a side view of the suspending means of FIG. 5.
Figure 5:
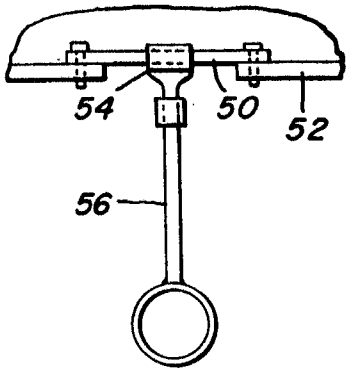
FIG. 5 is a partial view of a tundish showing an alternative suspending means.

FIGS. 5 and 6 show an alternative suspending means wherein axle 50 is fixed to tundish 52 and does not rotate. A hook 54 engages axle 50 to allow arcuate movement of the shroud tube into and out of the operative position. The hook 54 is fixed to support member 56 by any desired means such as a drift pin 58 or by welding. The hook 54 may be of sufficient width to prevent any wobbling of the shroud tube while being placed into or out of the operative position. Alternatively, hook 54 may have two or more spaced, connected hooks similar to a claw, which will act as a wide hook.

One of ordinary skill in the art will recognize that the invented shroud may be suspended from any bottom pour vessel including a ladle, of from any associated equipment which is itself attached to the pouring vessel.

SUMMARY OF THE ACHIEVEMENTS OF THE OBJECTS OF THE INVENTION

It is readily apparent from the foregoing that we have invented a shrouding apparatus suspendable from a bottom pour vessel which will protect a molten metal pouring stream issuing from such vessel from atmospheric contamination.

Although preferred and alternative embodiments have been shown and described in accordance with the patent statutes, it is clear that various modifications and additions may be made thereto by those skilled in the art without departing from the spirit and scope of the invention as set forth in the following claims.

What is claimed is:

1. In a tundish having at least one bottom-pour nozzle in its bottom wall, for teeming of molten metal therethrough, the improvement comprising:

(a) means fixed to said tundish for engagement and disengagement of a shroud tube suspension apparatus therein and for journaling said suspension apparatus about a horizontal axis;

(b) a shroud tube suspension apparatus comprising:

(i) an axle for engagement in said journaling means;

(ii) a suspension arm normal to and depending from said axle, said suspension arm including means for rotation about its longitudinal axis;

(iii) said suspension arm carrying at its lower extremity a shroud tube support arm having at one end a shroud tube with a vertically oriented longitudinal axis, and at its other end a counterweight; and (c) said shroud tube support arm comprising means communicating with a gas source and with said shroud tube for introducing a shrouding gas to the interior of said shroud tube; and (d) whereby said shroud tube is adapted for rotational movement about the longitudinal axis of said suspension arm into and out of an operative position against the bottom of said tundish and encompassing said bottompour nozzle, said molten metal stream having substantially the same pouring path as the vertical axis of said shroud tube when in the operative position.

2. Apparatus according to claim 1 wherein said counterweight is adjustably positionable on said shroud tube support arm and includes retaining means for holding said counterweight in a fixed position.

* * * * *